US008454197B2

(12) United States Patent
Hauschulte et al.

(10) Patent No.: US 8,454,197 B2
(45) Date of Patent: Jun. 4, 2013

(54) LED OPERATING ROOM LIGHT

(75) Inventors: Hermann Hauschulte, Arnsberg (DE); Guenter Jaeger, Moehnesse (DE)

(73) Assignee: TRILUX Medical GmbH & Co. KG, Arnsberg (DE)

( * ) Notice: Subject to any disclaimer, the term of this patent is extended or adjusted under 35 U.S.C. 154(b) by 505 days.

(21) Appl. No.: 12/681,632

(22) PCT Filed: Sep. 17, 2008

(86) PCT No.: PCT/DE2008/001548

§ 371 (c)(1),
(2), (4) Date: Apr. 5, 2010

(87) PCT Pub. No.: WO2009/043326

PCT Pub. Date: Apr. 9, 2009

(65) Prior Publication Data

US 2010/0226123 A1 Sep. 9, 2010

(30) Foreign Application Priority Data

Oct. 5, 2007 (DE) ..... 10 2007 048 115

(51) Int. Cl.
*F21S 4/00* (2006.01)
*F21V 21/00* (2006.01)

(52) U.S. Cl.
USPC ..... 362/249.03; 362/249.1; 362/239

(58) Field of Classification Search
USPC ..... 362/33, 240, 241, 239, 335, 249.03, 362/249.1
See application file for complete search history.

(56) References Cited

U.S. PATENT DOCUMENTS

| | | | | |
|---|---|---|---|---|
| 3,887,801 | A | 6/1975 | Ilzig et al. | |
| 4,025,778 | A | 5/1977 | Hayakawa | |
| 4,928,211 | A * | 5/1990 | Hallings et al. | 362/33 |
| 6,724,543 | B1 | 4/2004 | Chinniah et al. | |
| 2002/0080615 | A1 | 6/2002 | Marshall et al. | |
| 2007/0041167 | A1 * | 2/2007 | Nachi | 362/33 |

FOREIGN PATENT DOCUMENTS

| | | | |
|---|---|---|---|
| DE | 2305666 | A1 | 8/1974 |
| DE | 2548678 | A1 | 12/1976 |
| DE | 10051464 | A1 | 5/2002 |
| DE | 202006017525 | U1 | 1/2007 |
| DE | 102006040393 | A1 | 3/2008 |
| EP | 1113220 | A2 | 7/2001 |
| EP | 1568938 | B1 | 8/2005 |

(Continued)

OTHER PUBLICATIONS

DE 20 2006 017 525 U1 English Language Translation Feb. 15, 2007.*

(Continued)

*Primary Examiner* — Mariceli Santiago
*Assistant Examiner* — Glenn Zimmerman
(74) *Attorney, Agent, or Firm* — Panitch Schwarze Belisario & Nadel LLP

(57) ABSTRACT

A light for operating rooms includes a light housing (2), several LED illumination modules that are adjustable for focusing purposes, and a unit for focusing the illumination modules. In order to prevent the light from being accidentally moved from the center of gravity on a gimbal mount, the illumination modules encompass a swivel plate (32), which is pivotally mounted on the light housing (2) and is provided with an LED array (34) that is arranged thereon.

12 Claims, 4 Drawing Sheets

FOREIGN PATENT DOCUMENTS

| | | | |
|---|---|---|---|
| EP | 1722156 | A1 | 11/2006 |
| EP | 1741975 | A3 | 1/2007 |
| EP | 1568935 | B1 | 3/2007 |

OTHER PUBLICATIONS

International Search Report dated Feb. 16, 2009 from the European Patent Office concerning counterpart International Application No. PCT/DE2008/001548.

German Examinaton Report dated Sep. 25, 2008 from the German Patent Office concerning counterpart German Application No. 10 207 048 115.4-54.

International Preliminary Report on Patentability dated Apr. 15, 2010 from the International Bureau of WIPO concerning counterpart International Application No. PCT/DE2008/001548.

* cited by examiner

LED OPERATING ROOM LIGHT

CROSS-REFERENCE TO RELATED APPLICATIONS

This application is a Section 371 of International Application No. PCT/DE2008/001548, filed Sep. 17, 2008, which was published in the German language on Apr. 9, 2009, under International Publication No. WO 2009/043326 A1 and the disclosure of which is incorporated herein by reference.

BACKGROUND OF THE INVENTION

The present invention concerns an operating room (OP) light with a light casing, a plurality of LED illumination modules, which are displaceable for focusing purposes, and a focusing unit in the form of a linear transmission for focusing the illumination modules.

Preferably, the illumination modules are pivotably mounted in a satellite-like fashion to a central main light body. In that case, the main light body defines a working plane of the operating room light, about which the illumination modules are pivotable. In an operating room of an hospital, such a light provides a light cone which can be focused onto various focal points and which involves a particularly high level of luminous density at the focal point.

As various operations involve operating area sizes of differing magnitudes it is necessary to adapt the lighting field diameter of the operating room light to the operating area size and to be able to focus it to avoid dazzle effects due to reflections at the surrounding tissue.

The pivotal movement of the illumination modules for focusing onto different lighting field diameters is usually effected with an electric motor drive by way of adjusting motors. Those electric motors are cost-intensive and susceptible to trouble. Other known operating room lights include a central light which is adapted to be able to focus various light field diameters. That focusing is effected either by displacement of the lighting means or by displacement of the reflector which is arranged rearwardly behind the lighting means.

The main lighting body with the satellite bodies, which are pivotably secured thereto and which include the LEDs with a surrounding light casing, are usually fixed in existing operating room lights to the ceiling or to the component carrier by way of a gimbal suspension arrangement. A movement of the relatively heavy satellites in that case also changes the center of gravity of the entire light, which can cause unwanted rotation of the light at the gimbal suspension arrangement.

Based on the state of the art set forth in the opening part of this specification, a first object of the present invention is to at least partially avoid the aforementioned disadvantages and to provide an operating room light which permits inexpensive and trouble-free focusing, in particular, without causing unwanted displacement at the suspension arrangement.

BRIEF SUMMARY OF THE INVENTION

According to the present invention, the above object is attained in that the illumination modules include a pivot plate which is pivotably secured to the light casing and which has the LEDs arranged thereon.

The configuration according to the present invention provides that only the pivot plate mounted pivotably in the light casing now has to be displaced by the focusing unit or displacement unit, without moving the heavy light casing itself, which could cause a change in the center of gravity of the light. In contrast to the state of the art, the entire light casing is thus rigid and does not have any satellites which project in a star configuration pivotably at the central portion. Instead one or more pivot plates are preferably arranged in arms projecting radiatingly from the center of the light.

Usually the pivot plates are mounted on pivot shafts. In that case the pivot shafts preferably extend transversely relative to an axis extending through the center point of the operating room light, that is to say an axis passing radially outwardly in a star configuration from the center point.

Preferably also one or more pivot bars extend along those axes projecting radially in a star configuration, for transmission of the translatory movement of a central element, which is displaceable in respect of height by the rotary handle and to which the pivot shafts are pivotably fixed. Those pivot bars, which operate on the basis of the functional principle of a rocker and which are mounted at a rocker or pivot point, transmit the raising and lowering movement of the central element to the pivot plates for focusing the LED arrangements.

Mounting blocks can be provided at the tilt points for the pivot bars, such blocks permitting the simultaneous implementation of a translatory and a rotational movement. In the preferred embodiment those mounting blocks include a ball joint which is rotatably accommodated in a receiving element and which has a central through opening for the pivot bar. By means of those ball joints which peripherally accommodate the pivot bars the pivot bars can at the same time perform their pivotal movement and also effect a translatory movement in the ball joints functioning as sliding bearings. Preferably, the balls of the ball joint comprise a plastic material with good sliding properties to implement a sliding movement of the bar and an angular displacement.

In accordance with a preferred embodiment of the present invention, a plurality of illumination modules can be provided in a plurality of arms projecting radially from the center of the operating room light, each of which is arranged pivotably on a pivot plate which is adjustable by the linear transmission. In principle, it is admittedly possible for the individual pivot plates to be adjustable independently of each other; the preferred embodiment however provides that the pivot plates of the individual LED arrangements can be unitarily focused by unitary rotation of the focusing unit. In that case therefore adjustment of all illumination modules takes place synchronously.

A further aspect of the present invention concerns the configuration of the collimator lens. Collimator lenses are used for focusing the light emitted by LEDs, in particular for power LEDs. Existing collimator lenses involve the problem that blue light is produced in the peripheral edge region, and that light, in the operating room area, leads to an unwanted change in the light and thus color reproduction index so that unnatural color impressions can occur at the operation wound.

Taking that state of the art as the basic starting point, a further object of the present invention is to at least partially avoid that disadvantage and to provide a collimator lens which has no or only slight unwanted change in the peripheral edge region, which disrupts the color reproduction index.

According to the present invention, that object is attained in that the radius of curvature of the outer peripheral surface of the collimator lens, the height of the collimator lens, the light entry surface, the size and geometrical configuration of the light exit surface and the geometry of the light exit surface are so matched to each other that the blue light is avoided in the edge region of the lens by mixing into a central region. In addition, the light exit surface is provided with a given structured surface to produce a given light refraction. The peripheral surface is preferably slightly convexly curved outwardly.

In a further development, the collimator lens is also adapted to achieve a light distribution curve which has a half-value angle in a range of between ±2 and 2.5 degrees, preferably ±2.0 degrees, and the tenth-value angle has a range of between 4.0 and 5.0 degrees, preferably 4.0 degrees.

To avoid stray light, each collimator lens is fitted upon installation in a cup-shaped holder which is arranged above the LED and which permits light entry through a lower opening and light exit through the light exit surface of the collimator lens at the front end.

Preferably, that cup-shaped holder comprises a black plastic material and is in the form of an injection molding. According to the present invention, each collimator lens is arranged in such a holder in front of an LED. It is usual in that respect for the holder to be glued in position with a double-sided adhesive strip in front of the LED.

A third aspect of the present invention is concerned with the problems of achieving illumination which is as homogenous as possible in regard to color distribution in the operating room area. In principle it is desirable for the light produced by the LEDs to have a color reproduction index which is as high as possible and which is as similar as possible to natural light or sunlight as that does not change the wound color impression. Existing LEDs however produce a light which has a relatively high proportion of white light, which can lead to an unwanted wound color impression.

A further object of the present invention is, therefore, that of also at least partially avoiding those disadvantages and providing a light which permits the use of LEDs in an operating room light to achieve a color reproduction index which is as high as possible.

According to the present invention, the above object is substantially attained in that there are provided different LED arrangements of individual LEDs, which have different arrangements of colored LEDs. To achieve illumination which is as homogenous as possible in regard to color distribution, preferably green LEDs and red LEDs are used, beside white LEDs. In that respect, it has proven to be particularly desirable to combine an embodiment with the colored LEDs more in the edge region of the LED arrangement with a further embodiment with the colored LEDs more in the central inner region in such a way that the colors are superposed at the focus to achieve a color reproduction index of greater than 90, preferably to achieve a color reproduction index of greater than 95 in the entire focal region. In that case the differing arrangements provide for intermixing of the individual colors to improve the color reproduction index. In addition the arrangement according to the invention avoids colored shadows.

A preferred development provides that the differently colored LEDs can also be differently supplied with power. To comply with the low-voltage directive it is advantageous for the connection value of a plurality of series-arranged LEDs not to exceed a voltage of a maximum of 50 volts. It is particularly advantageous to operate two circuits for white LEDs, one circuit for red LEDs and one circuit for green LEDs. The best results were achieved if the red circuit is operated with about 40-50% of the current of the white and the green circuits.

In development, it was further found that using current dimming instead of the pulse width modulation which is known in the state of the art very substantially avoids electromagnetic interference which can lead to image disruptions in imaging systems. Thus the imaging power of imaging systems can be considerably improved by current dimming according to the invention.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
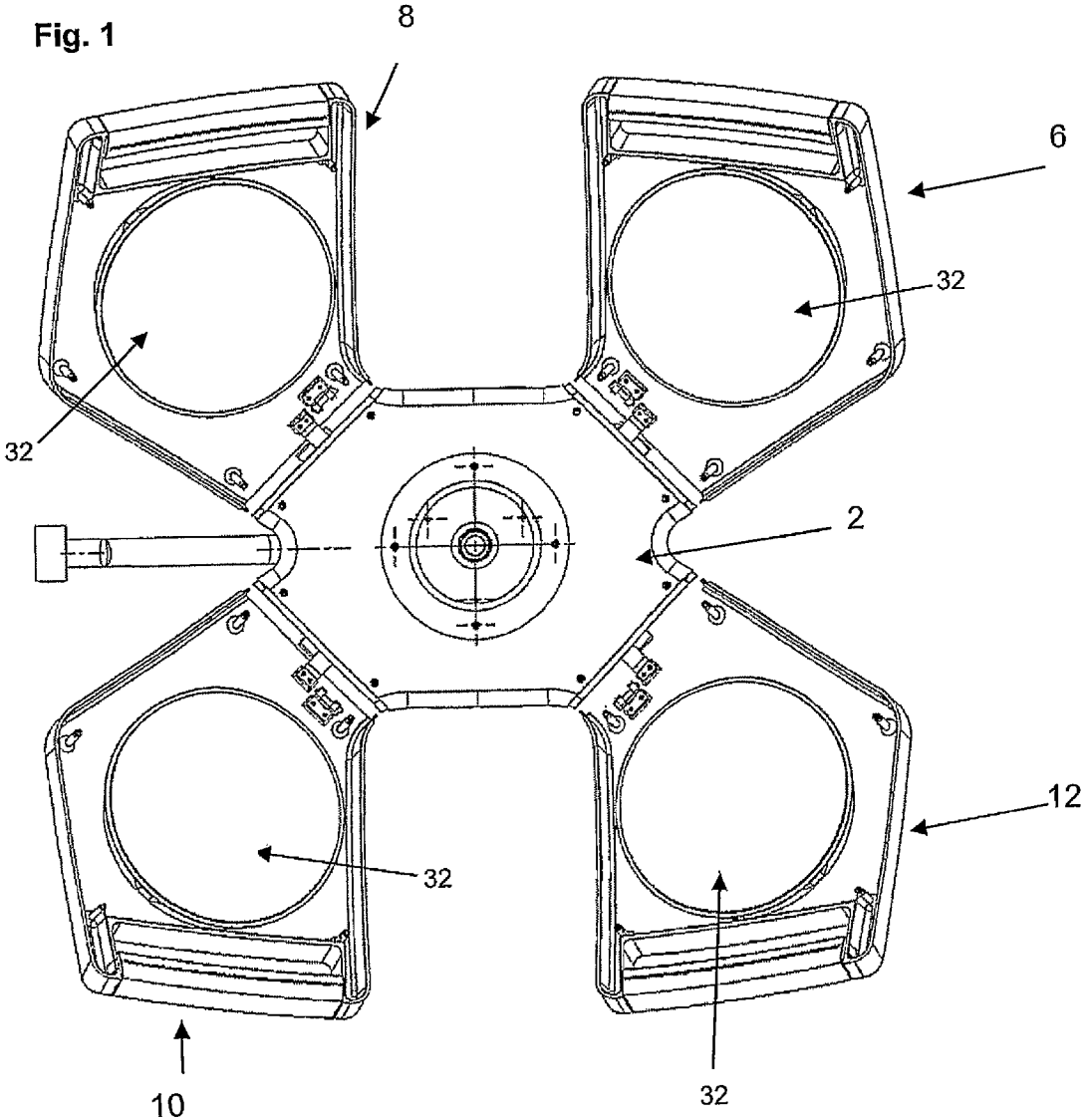
FIG. 1 is a plan view of an operating room light with four arms according to a preferred embodiment of the present invention.

Certain terminology is used in the following description for convenience only and is not limiting. The words "upper" and "lower" designate directions in the drawings to which reference is made. The words "first," "second," "third," and "fourth" designate an order or operations in the drawings to which reference is made, but do not limit these steps to the exact order described. The words "inner," "outer," "inwardly" and "outwardly" refer to directions toward and away from, respectively, the geometric center of the device and designated parts thereof. Additionally, the terms "a," "an" and "the," as used in the specification, mean "at least one." The terminology includes the words above specifically mentioned, derivatives thereof, and words of similar import.

Further details, advantages and features of the present invention will be apparent from the following part of the description in which a preferred embodiment of the operating room light according to the invention is described in greater detail. Referring to the drawings in detail, wherein like numerals indicate like elements throughout, there is shown in FIGS. 1-7 an operating room light, and designated portions thereof, in accordance with the present invention.

Accordingly, the operating room light according to the present invention preferably includes a light casing 2 having a central region 4, from which a first arm 6, a second arm 8, a third arm 10 and a fourth arm 12 extend in a general star configuration at a respective angle of about 45° from the center point of the central region 4. Circular pivot plates 32 for LED arrangements 34 are arranged pivotably on pivot shafts 42 for focusing purposes, at the undersides of the outer ends of the arms 6, 8, 10, 12.

Figure 2:
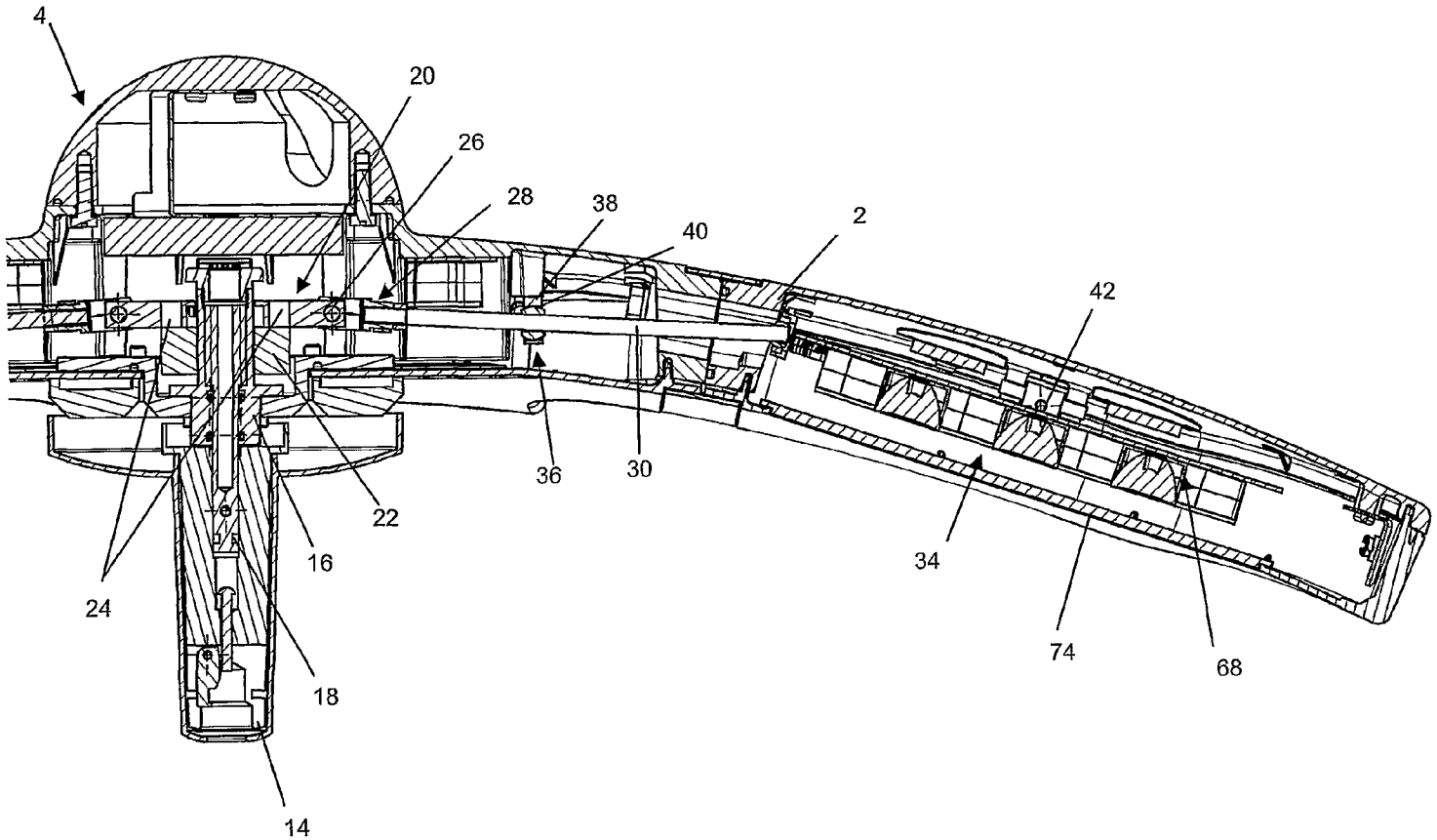
FIG. 2 is a cross-sectional elevation view of one of the arms of the operating room light shown in FIG. 1.

A focusing unit of the operating room light, which is shown on an enlarged scale in the sectional view in FIG. 2, preferably includes a rotary handle 14 arranged rotatably at the underside at the center point of the central region 4. Rotation of that rotary handle 14 preferably drives an inwardly disposed spindle 18 which is accommodated in the rotary handle 14 in an arresting sleeve 16. In dependence on the direction of rotation that spindle 18 raises or lowers, a displacement unit in the form of a displacement cross member 20. The displacement cross member 20 preferably includes a cylindrical lower portion 22, at the enlarged upper end of which there are provided four radially projecting holding arms 24, of which each of two holding arms 24 are arranged in mutually paired colinear relationship and cross with the other pair of colinear holding arms, with the inclusion of an angle of 90 degrees. Each holding arm 24, which is preferably flattened on both sides, has a circular through opening 26 at its radially outer end.

In the preferred embodiment, four fork heads 28 are pivotably secured by way of a respective pin to the through openings 26. At their outer free ends, the fork heads 28 are preferably provided with mounting bushes of pivot bars 30. The mounting bushes preferably include female screwthreads into which screwthreads of a corresponding configuration on the inner ends of the pivot bars 30 are screwed. The pivot bars 30 preferably form a pivot lever structure according to the present invention for pivotal movement of the pivot elements in the form of pivot plates 32, with LED arrangements 34 arranged thereon, which in the preferred embodiment each include 37 LEDs of different colors.

Each pivot bar 30 is preferably pivotably connected at its inner end with a fork head 28 to a holding arm 24 of the displacement cross member 20 and is pivotably connected at its outer end to a pivot plate 32. Approximately at the center the pivot bars 30 are each guided through a respective ball joint 36. The ball joints 36 preferably each include an annular outer holding element 38 with fixing tongues which project at the upper side and which are fixed to the light casing, and a ball-shaped slide bearing 40 which is fitted into the annular holding element and the outside diameter of which corresponds to the inside diameter of the holding element 38 and which has a central through opening of the same size at the outside diameter of the pivot bar 30. The pivot bar 30 passes through that central through opening. Upon heightwise displacement of the displacement cross member 20 by rotation of the rotary handle 14, the pivot bars 30 are preferably caused to pivot about the radially projecting holding arms 24. The fact that the pivot bars 30 are supported in the sliding bearings 40 provides a tilting lever structure, which thus causes pivotal movement of the pivot plates 32 about the pivot shafts 42 arranged therebeneath. In that way the LED arrangements 34 positioned on the pivot plates 32 can all be simultaneously focused onto the desired focal point by performing a rotary movement at the rotary handle 14. The present invention thus represents a particularly simple, inexpensive and robust adjusting means in comparison with the state of the art.

Figure 6:
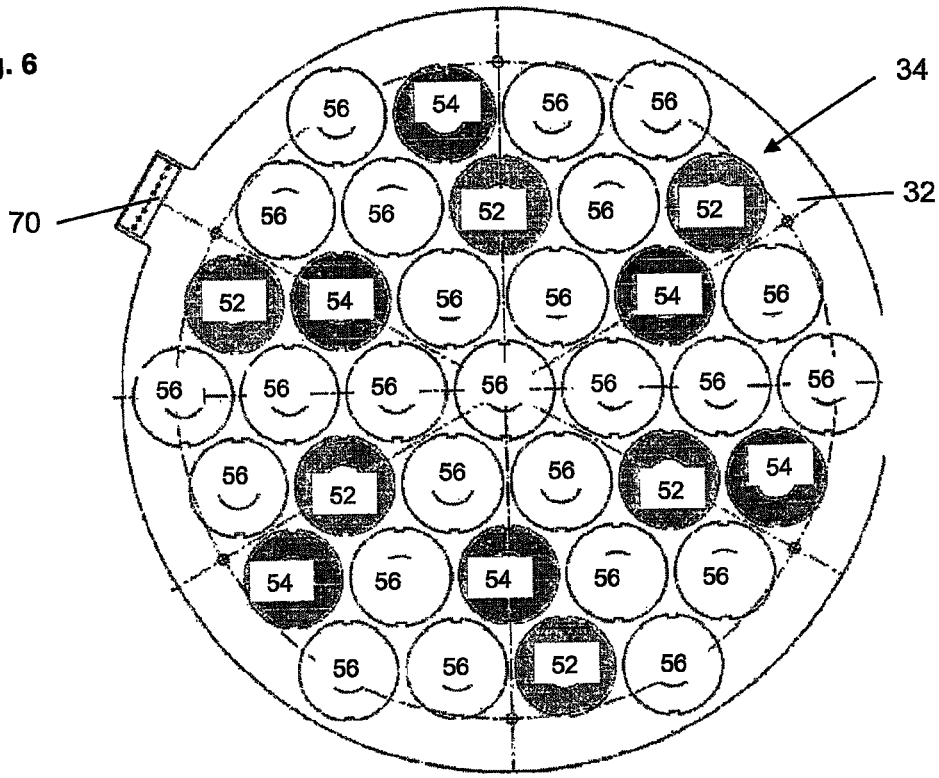
FIG. 6 is a plan view of a first preferred embodiment of an LED arrangement in second and fourth arms of the operating room light shown in FIG. 1.
Figure 7:
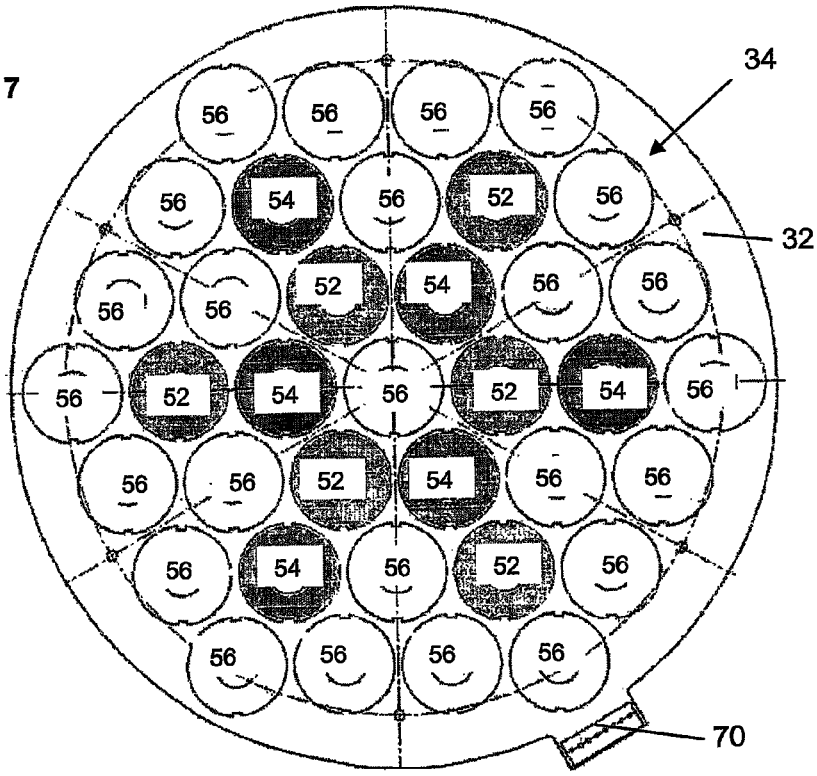
FIG. 7 is a plan view of a second preferred embodiment of an LED arrangement in first and third arms of the operating room light shown in FIG. 1.

As can be seen from FIGS. 2, 6 and 7, the present invention preferably includes four LED arrangements 34 which are disposed satellite-like around the central region 4 and each of which includes a total of 37 LEDs each with a collimator lens 50 associated with each LED.

Two respective LED arrangements 34 disposed in paired diametrally opposite relationship in the arms 6, 8, 10, 12 preferably have the same arrangements of colored LEDs. In the present case, to achieve illumination which is as homogenous as possible in respect of the color distribution, green LEDs 52 and red LEDs 54 are used in various positions besides white LEDs 56, and, more specifically, in an embodiment as shown in FIG. 6 with the colored LEDs more in the outer region of the LED arrangement 34 and in another embodiment as shown in FIG. 7 with the colored LEDs more in the central region of the LED arrangement 34. The respectively identical LED arrangements 34 are preferably disposed in diametrally opposite mirror-symmetrical relationship on the arms 6, 8, 10 and 12 of the operating room light. At a distance of about 1 meter from the light at the focus the superpositioning of the colors red, green and white produces a homogenous lighting field with a color reproduction index of greater than 95 in the entire focus region. The arrangement selected in the present case of six green LEDs 52 and six red LEDs 54 respectively besides 25 white LEDs 56 produces illumination which is as homogenous as possible in regard to color distribution in the light field. In addition, that arrangement almost completely avoids colored shadows, which is essential for a clear representation of the wound in the operating room region.

The above described color reproduction index is also achieved by the differing power supply for the differently colored LEDs. The low voltage directive is complied with, in operation of the light according to the invention, in that each circuit of a plurality of LEDs takes at a maximum a 50 volt voltage. In that case, two white circuits, a red and a green circuit, are operated by a respective ECG (electronic ballast or control gear). In that case, the supply of current is such that the red circuit is operated at between about 40 and 50% of the current of the white and green circuits.

Using that current dimming instead of the pulse width modulation which is usual in the state of the art avoids image disruptions on modern imaging systems, caused by electromagnetic interference phenomena. In accordance with the present invention, therefore, the imaging power and efficiency of imaging systems is considerably improved.

Figure 5:
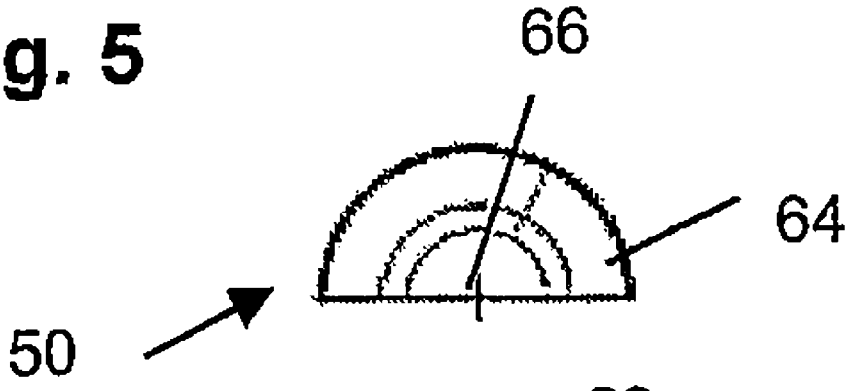
FIG. 5 is a partly sectional plan view of a light exit end of the collimator lens shown in FIG. 3.
Figure 3:
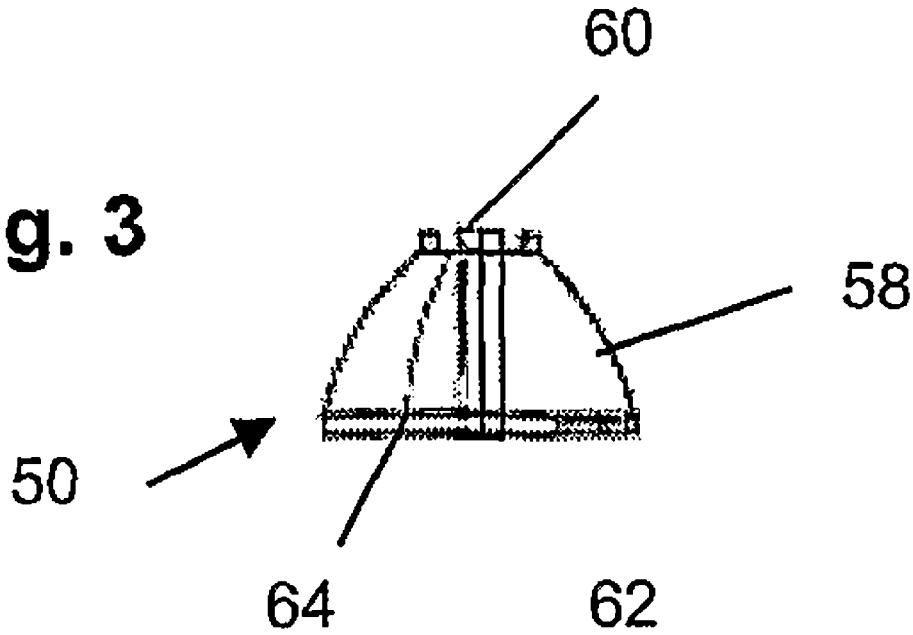
FIG. 3 is a side elevation view of a collimator lens according to a preferred embodiment of the present invention.
Figure 4:
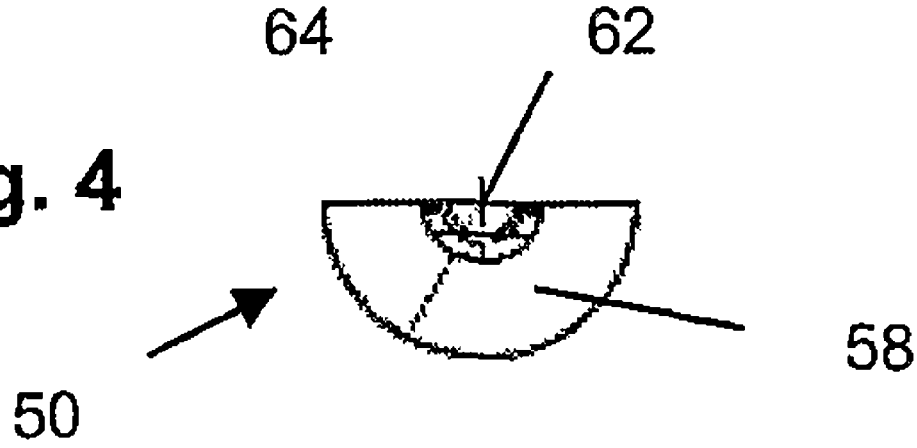
FIG. 4 is a partly sectional plan view of a light entry end of the collimator lens shown in FIG. 3.

FIGS. 3-5 show a collimator lens 50 according to the present invention, which is also referred to as a rectifier lens and which is fitted in the beam direction onto the individual LEDs to focus the light emitted by the LEDs. The collimator lenses 50 perform the function of the primary lens, in the operating room light. The collimator lenses 50, which operate on the principle of total reflection, are preferably in the form of PMMA—injection moldings involving the geometry of a circular truncated cone which has an outer and peripherally extending peripheral surface 58, a light entry surface 60 which is downward in the position of installation, with a recess 62 for the LED with the collimator lens 50 when it is fitted in place and a light exit surface 64 which is upward in the position of installation and the diameter of which is larger in the ratio of 3.7:1 than the light entry surface 62. According to the present invention, the peripheral surface 58 is preferably of a slightly convexly curved configuration. The interplay of the radii of curvature of the outer peripheral surface 58, the size of the light entry surface 60, the size of the light exit surface 64, the height of the collimator lens 50 and the configuration of the surface of the light exit surface 64 achieves a light distribution curve which has a half-value angle of in the range of between +/−2.0 and 2.5 degrees, preferably +/−2.0 degrees, and the tenth-value angle has a range of between 4.0 and 5.0 degrees, preferably 4.0 degrees.

The light exit surface 64 is initially convexly curved from the outside inwardly and then goes into a flat center 66, which in the present case is about 1:1.6 times as large as the overall diameter of the light exit surface 64. Grooving on the light exit surface 64 avoids the blue light, which is known from the state of the art and which is viewed as a fault in the edge region of each collimator lens 50 by virtue of the fact that it is centrally mixed in. To achieve the effects according to the present invention the dimensional relationships are as follows:

diameter of the light entry surface/diameter of the light exit surface: 1:1.7;

height of the lens/diameter of the light exit surface: 1:1.7.

The dimensions in a preferred embodiment are as follows:

| | |
|---|---|
| Diameter of the light entry surface: | 7.10 mm |
| Diameter of the light exit surface: | 26.50 mm |
| Diameter of flat center of the light exit surface: | 16.21 mm |
| Height of the lens: | 15.85 mm |
| Height of the recess at the light entry surface: | 5.12 mm |
| Radius of curvature of the peripheral surface: | 5.96 mm |

Each of the collimator lenses 50 in the LED arrangement 34 is preferably fixed in an upwardly open, cup-shaped holder 68 on the pivot plate 32 above the LEDs. The holder 68 preferably peripherally surrounds the collimator lens 50, except for the light exit surface 64. The light radiated at the underside into an opening of the holder 68 by the respective LED is focused by the collimator lens 50 and emitted with a reduction in the stray light through the holder 68 which comprises a black plastic material, at the light exit surface 64.

The preferred embodiments shown in FIGS. 6 and 7 of LED arrangements 34 with different arrangements of colored LEDs, of which in the present case two identical arrangements 34 are respectively disposed in diametrally opposite relationship in the arms 6, 8, 10, 12, are supplemented by superpositioning of the colors at the focus to achieve a homogenous light field with a high color reproduction index of greater than 90, preferably greater than 95. It will be appreciated that this result can also be achieved by a plurality of arms with corresponding LED arrangements 34 by superpositioning of the colors emitted by the LEDs.

Preferably, the pivot plates respectively have connecting plugs 70 which project radially at one side and with which the LED arrangements 34 can be connected to the ECGs of the light and to supply devices in the central region 4 of the light.

After all collimator lenses 50, which perform the function of primary lenses. are fitted onto the LEDs, in addition a casing cover 72 with an opening and a casing lens 74 fitted in that opening is additionally fitted. That casing lens 74 performs the function of the secondary lens and focuses the individual light beams emitted by way of the LEDs to give an overall beam. The secondary lens is preferably in the form of a Fresnel lens and focuses the light of the individual primary lenses on the focusing point which is about one meter away. The casing lens 74 preferably includes a main lens body for maintaining a minimum material thickness and steps which are arranged thereon and which extend concentrically relative to the center point and which bear more closely against each other in the outer region and are further away from each other in the inner region, that is to say have wider steps, because the total height of the hypothetical lens with the corresponding curvature for focusing purposes is projected onto the desired material thickness.

In a development, a further LED arrangement can be disposed concentrically about the rotary handle 14 at the central region 4. That LED arrangement preferably includes only white LEDs.

It will be appreciated that the invention is not limited to the use of four satellite lights, but also embraces solutions having more or fewer satellites.

The subject-matter of the present invention involves not only the subject-matter of the individual patent claims but also the combination of the individual claims with each other. All features and details disclosed in the documents, in particular the spatial configuration illustrated in the drawings, are essentially claimed at the present invention insofar as they are novel individually or in combination in comparison with the state of the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An operating room light comprising:
- a light casing having a central region;
- a plurality of arms (6, 8, 10, 12) connected to the central region;
- a plurality of LED illumination modules, each module comprising:
  - a pivotable plate (32) pivotably connected to one separate arm of the plurality of arms; and
  - an LED arrangement (34) supported by the pivotable plate (32); and
- a focusing unit comprising:
  - a rotary handle (14) having an axis of rotation;
  - a displaceable element coupled to the rotary handle, the displaceable element displaceable in translation along the axis of rotation of the rotatable handle when the rotary handle rotates; and
  - at least one pivot bar pivotably mounted in a rocker point (36), the at least one pivot bar having one end operatively coupled to the displaceable element and the other end operatively coupled to the pivotable plate, the at least one pivot bar displacing the pivotable plate when the pivot bar moves in a rocking motion.

2. An operating room light as set forth in claim 1 wherein the pivot plates (32) are mounted on pivot shafts (42).

3. An operating room light as set forth in claim 2 wherein the pivot shafts (42) extend transversely to an axis extending through the center point of the operating room light.

4. An operating room light as set forth in claim 3 wherein the pivot shafts (42) define a right angle with the axis passing through the center point of the operating room light.

5. An operating room light as set forth in claim 1 wherein the at least one pivot bar (30) pivotably mounted to the displaceable element is mounted pivotably in a rocker point for displacement of the pivot plate (32), with the performance of a rocking movement.

6. An operating room light as set forth in claim 5 wherein provided at the rocker point is a mounting block which permits the simultaneous execution of a translatory and a rotational movement.

7. An operating room light as set forth in claim 6 wherein the mounting block includes a ball joint (36) rotatably accommodated in a holding element (38).

8. An operating room light as set forth in claim 1 wherein focusing is effected synchronously by a plurality of pivot plates (32) with LED arrangements (34) arranged thereon.

9. An operating room light comprising;
- a light casing;
- a plurality of LED illumination modules displaceable for focusing purposes, the illumination modules including a pivot plate (32) pivotably fixed to the light casing (2) and have an LED arrangement (34) arranged thereon;
- a focusing unit for focusing the illumination modules, the focusing unit including a displacement element which is displaceable with respect to height by way of a rotary handle (14) and to which there is pivotably mounted—at least one pivot bar (30) mounted pivotably in a rocker point for displacement of the pivot plate (32), with the performance of a rocking movement, wherein the displacement element is in the form of a displacement cross member (20).

10. An operating room light comprising:

a light casing;

a plurality of LED illumination modules displaceable for focusing purposes, the illumination modules including a pivot plate (32) pivotably fixed to the light casing (2) and have an LED arrangement (34) arranged thereon;

a focusing unit for focusing the illumination modules; and a collimator lens, which has the geometry of a circular truncated cone and which has a peripherally extending peripheral surface (58), a light entry surface (60) which is downward in the position of installation and has a recess (62) and a light exit surface (64) which is upward in the position of installation, wherein a radius of curvature of the outer peripheral surface (58), the height of the collimator lens (50), the light entry surface (60), the size and geometrical configuration of the light exit surface (64) and a surface of the light exit surface (64) are matched to each other to avoid blue light in the edge region of the lens by mixing into a central region.

11. An operating room light as set forth in claim 10 wherein the collimator lens is adapted to achieve a light distribution curve which has a half-value angle in the range of between ±2 and ±2.5 degrees, and the tenth-value angle has a range of between ±4.0 and ±5.0 degrees.

12. An operating room light as set forth in claim 5 wherein the rocker point is positioned between the one end and the other end of the pivot bar.

* * * * *